US009493975B1

(12) United States Patent
Li

(10) Patent No.: US 9,493,975 B1
(45) Date of Patent: Nov. 15, 2016

(54) MOVEMENT AND ELASTIC ABUTTING DEVICE OF A TWO LINK MECHANISM

(71) Applicant: OME TECHNOLOGY CO., LTD., New Taipei (TW)

(72) Inventor: Kun-Fei Li, Taipei (TW)

(73) Assignee: OME TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 14/866,271

(22) Filed: Sep. 25, 2015

(30) Foreign Application Priority Data

Jul. 31, 2015 (TW) ..... 104212364 U

(51) Int. Cl.
*E05F 5/02* (2006.01)
*E06B 3/32* (2006.01)
*E06B 3/50* (2006.01)

(52) U.S. Cl.
CPC ..... *E05F 5/02* (2013.01); *E06B 3/325* (2013.01); *E06B 3/5018* (2013.01)

(58) Field of Classification Search
CPC ..... E05F 5/02; E06B 3/5018; E06B 3/325
USPC ..... 49/364; 16/85
See application file for complete search history.

(56) References Cited

U.S. PATENT DOCUMENTS 1,730,646 A * 10/1929 Danner ..... E05F 5/02 16/84
3,605,459 A * 9/1971 Van Dalen ..... E05B 47/0038 292/144
4,039,018 A * 8/1977 De Maria ..... E06B 3/2605 160/187
6,000,734 A * 12/1999 Prevot ..... E05B 63/185 292/99
8,844,195 B2 * 9/2014 Cox ..... E06B 5/167 49/7
9,080,379 B2 * 7/2015 Guillemette ..... E05D 15/262
2004/0231099 A1 * 11/2004 Li ..... E05F 5/02 16/85
2005/0217072 A1 * 10/2005 Lin ..... E05F 5/02 16/85
2007/0226954 A1 * 10/2007 Artsiely ..... E05F 5/02 16/63
2008/0295283 A1 * 12/2008 Tice ..... E05C 19/16 16/84
2012/0060436 A1 * 3/2012 Zimmer, II ..... F41H 5/06 52/202
2013/0292067 A1 * 11/2013 Lucas ..... E05F 15/605 160/213
2013/0319623 A1 * 12/2013 Crown ..... E06B 3/483 160/224

FOREIGN PATENT DOCUMENTS

AT 10097 U1 * 9/2008 ..... A47B 88/04
IT DE 29913854 U1 * 10/1999 ..... E05F 5/02
KR 100760518 B1 * 9/2007 ..... E05F 5/02
NZ WO 2015142187 A1 * 9/2015 ..... E05F 5/02

* cited by examiner

*Primary Examiner* — Jerry Redman
(74) *Attorney, Agent, or Firm* — Li&Cai Intellectual Property (USA) Office

(57) ABSTRACT

An elastic abutting device disposed on one link of a two link mechanism includes a base member, a bearing member, a latch member, and an elastic member. The base member has an accommodating groove. The bearing member is disposed in the accommodating groove, wherein the bearing member has a first propping portion, a second propping portion, and a through hole. The latch member defines a central axis, and the latch member has an abutting portion which is partly exposed out of the through hole and a retaining portion which is disposed correspondingly to the abutting portion. The elastic member is disposed between the first propping portion and the second propping portion, wherein two opposite terminal ends of the elastic member respectively have a first side end portion and a second side end portion disposed correspondingly to the first side end portion.

10 Claims, 11 Drawing Sheets

MOVEMENT AND ELASTIC ABUTTING DEVICE OF A TWO LINK MECHANISM

BACKGROUND OF THE INVENTION

1. Field of the Invention

The instant disclosure relates to an elastic abutting device; in particular, to movement and elastic abutting device of a two link mechanism.

2. Description of Related Art

Conventional windows and window frames are opened or closed mostly by pulling to move them in a horizontal direction. Although it is easy to operate and save the interior space, these kinds of windows and window frames have a maximum open area that only occupies half of the entire window area. For this reason, the radiating efficiency and the close tightness are inferior. The abovementioned problems bring users a lot of inconvenience.

Therefore, the industry gradually developed movable windows and window frames, such as a vertically movable venetian blind, and a vertically movable folding window. However, the folding window with two link mechanism in the present market needs to be opened or closed by manual operation. If these kinds of windows and window frames are set at a higher position, they cannot be opened or closed by manual operation, hence a drive unit (e.g., stepper motor) is necessary to be used to drive the opening and closing movement. But, the two link folding window is liable to generate a dead point problem when using the drive unit to drive the movement, and it causes a problem that the folding window cannot be opened.

For such reasons as above, to provide a movement and elastic abutting devices of two link mechanism to overcome the abovementioned drawbacks is one of the important issues in the industry.

SUMMARY OF THE INVENTION

The technical problem need to be solved by this instant disclosure is that, this instant disclosure provides a movement and elastic abutting device of a two link mechanism, which can avoid a dead point generated from a two link mechanism or from a movement device with a two link mechanism.

In order to achieve the abovementioned purpose, an embodiment of this instant disclosure provides an elastic abutting device disposed on one link of a two link mechanism which includes a base member, a bearing member, a latch member, and an elastic member. The base member has an accommodating groove. The bearing member is disposed in the accommodating groove, wherein the bearing member has a first propping portion, a second propping portion corresponding to the first propping portion, and a through hole. The first propping portion and the second propping portion cooperatively define a receiving space, the through hole is disposed on the second propping portion, and the receiving space and the through hole are communicated with each other. The latch member defines a central axis, and the latch member has an abutting portion which is partly exposed out of the through hole and a retaining portion which is disposed correspondingly to the abutting portion, wherein the retaining portion has a propping surface and a stopping surface corresponding to the propping surface. The elastic member is disposed between the first propping portion and the second propping portion, wherein two opposite terminal ends of the elastic member respectively have a first side end portion and a second side end portion disposed correspondingly to the first side end portion. Wherein the retaining portion is disposed between the elastic member and the second propping portion, the first side end portion is propped against the first propping portion, and the second side end portion is propped against the propping surface of the latch member, so that the latch member is abutted against by the elastic member to reciprocate between a first position and a second position relative to the base member along the central axis.

Another embodiment of this instant disclosure provides a movement device having a two link mechanism which includes a frame unit, a first movement unit, a second movement unit, and an elastic abutting device. The frame unit defines a major axis direction. The first movement unit includes a first positioning portion and a first pin joint portion disposed correspondingly to the first positioning portion, and the first positioning portion is pin-jointed with the frame unit. The second movement unit includes a second pin joint portion and a second positioning portion disposed correspondingly to the second pin joint portion, wherein the second positioning portion is slidably disposed on the frame unit, so that the second movement unit is moved toward or away from the first positioning portion along the major axis direction. The elastic abutting device includes a base member, a bearing member, a latch member, and an elastic member. The base member is disposed on the first movement unit or on the second movement unit, wherein the base member has an accommodating groove. The bearing member is disposed in the accommodating groove, wherein the bearing member has a first propping portion, a second propping portion corresponding to the first propping portion, and a through hole. The first propping portion and the second propping portion cooperatively define a receiving space, the through hole is disposed on the second propping portion, the through hole is disposed on the second propping portion, and the receiving space and the through hole are communicated with each other. The latch member defines a central axis, and the latch member has an abutting portion which is partly exposed out of the through hole and a retaining portion which is disposed correspondingly to the abutting portion, wherein the retaining portion has a propping surface and a stopping surface corresponding to the propping surface. The elastic member is disposed between the first propping portion and the second propping portion, wherein two opposite terminal ends of the elastic member respectively have a first side end portion and a second side end portion disposed correspondingly to the first side end portion. Wherein the retaining portion is disposed between the elastic member and the second propping portion, the first side end portion is propped against the first propping portion, and the second side end portion is propped against the propping surface of the latch member, so that the latch member is abutted against by the elastic member and the frame unit to reciprocate between a first position and a second position relative to the base member along the central axis.

Accordingly, the movement and elastic abutting devices of two link mechanism of the embodiment in this instant disclosure has the benefit that the dead point of the two link mechanism or the movement device having the two link mechanism can be avoided by a slight elasticity applied from the elastic member of the elastic abutting device.

In order to further appreciate the characteristics and technical contents of the present invention, references are hereunder made to the detailed descriptions and appended drawings in connection with the instant disclosure. However, the appended drawings are merely shown for exemplary purposes, rather than being used to restrict the scope of the instant disclosure.

DETAILED DESCRIPTION OF THE PREFERRED EMBODIMENTS

Figure 1:
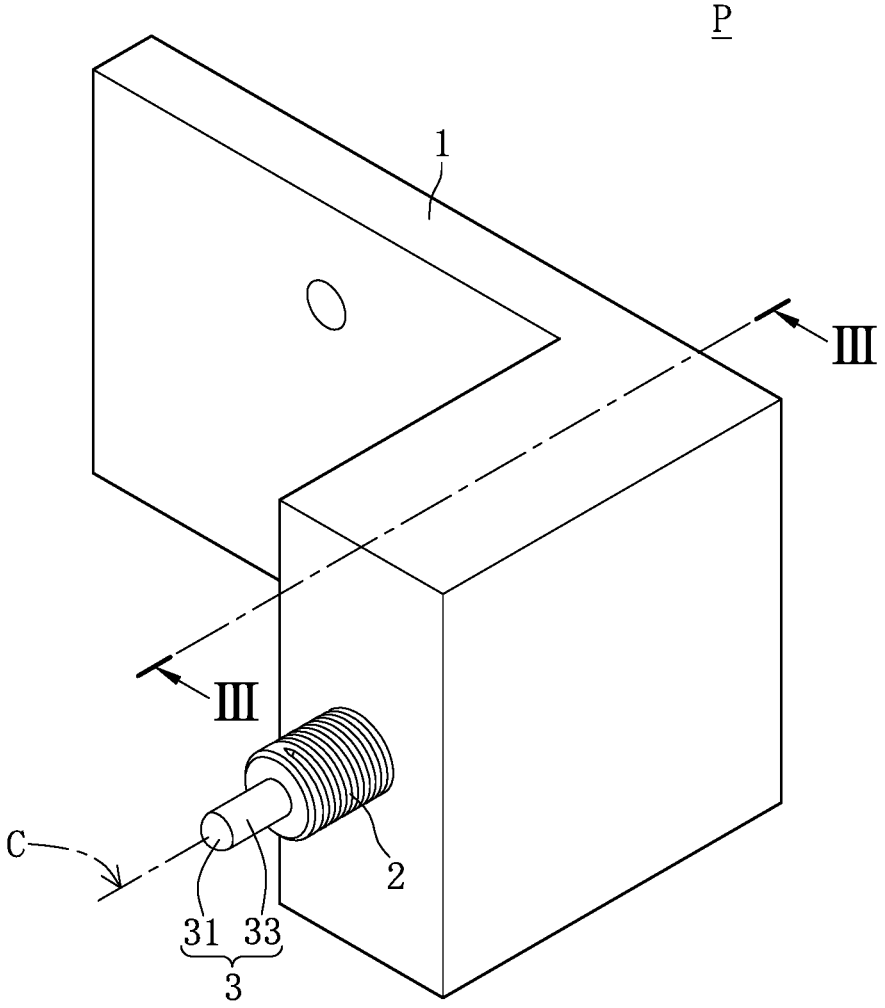
FIG. 1 shows a combination perspective view of an elastic abutting device of a first embodiment in the instant disclosure.
Figure 2:
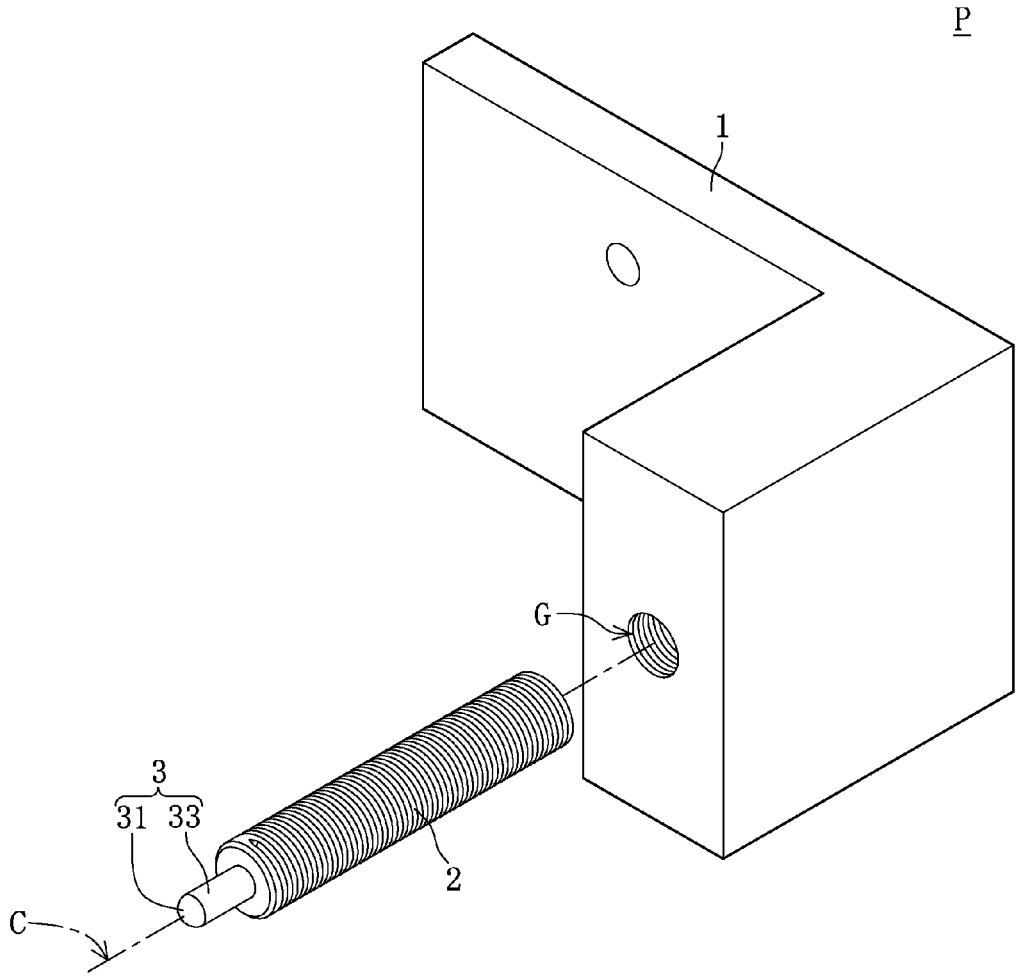
FIG. 2 shows a exploded perspective view of an elastic abutting device of a first embodiment in the instant disclosure.
Figure 3:
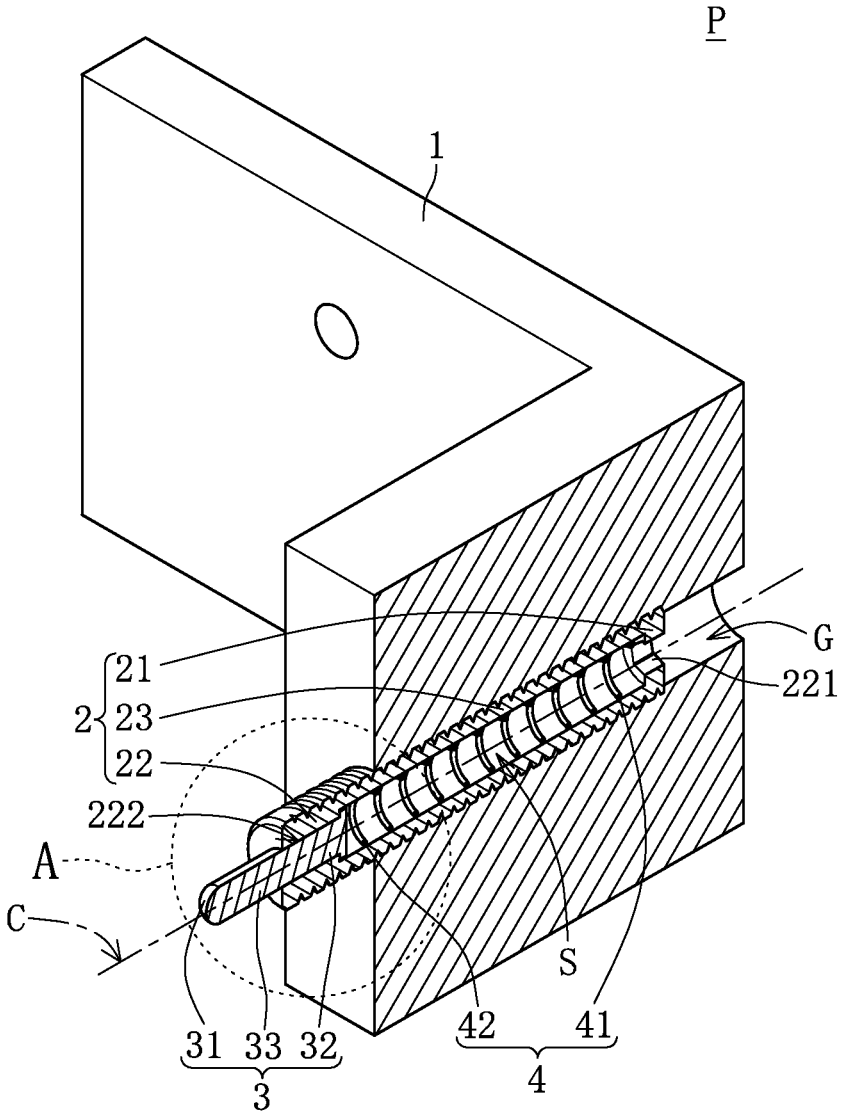
FIG. 3 shows a cross-sectional perspective view along line III-III of FIG. 1.
Figure 4:
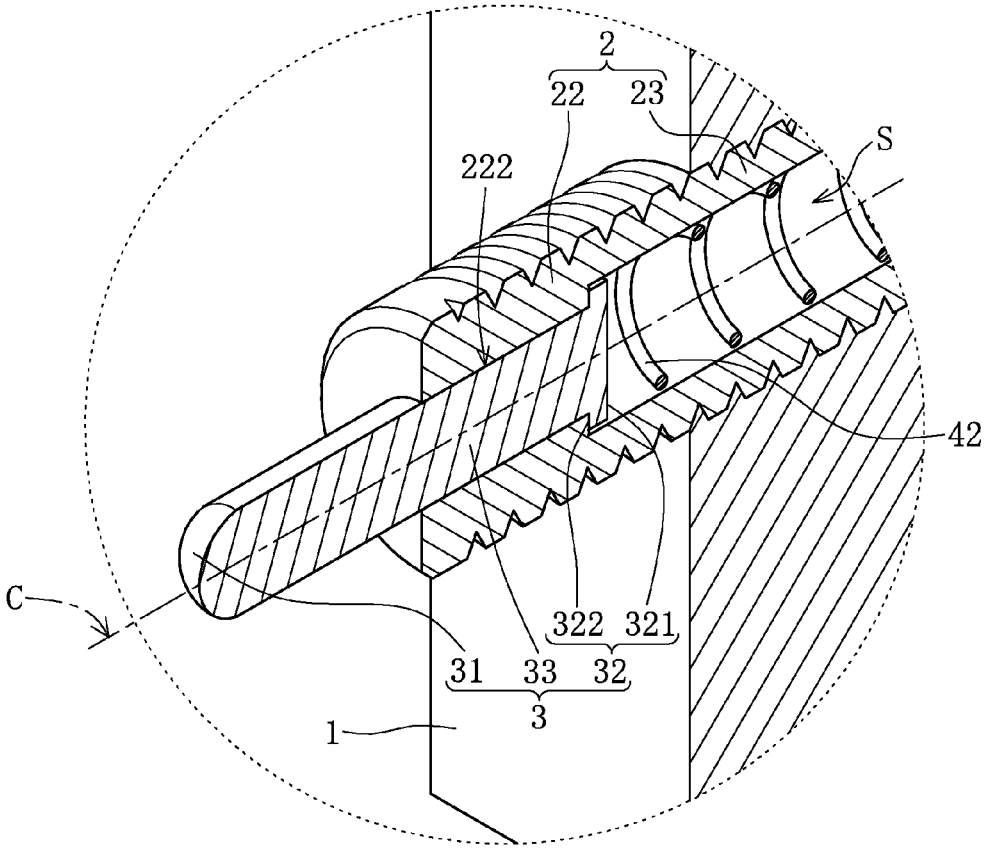
FIG. 4 shows a partial enlarged schematic view of A part of FIG. 3.

Embodiments of the movement and elastic abutting device with two link mechanism disclosed in the instant disclosure are illustrated via specific examples as follows, and people familiar in the art may easily understand the advantages and efficacies of the instant disclosure by disclosure of the specification. The instant disclosure may be implemented or applied by other different specific examples, and each of the details in the specification may be applied based on different views and may be modified and changed under the existence of the spirit of the instant disclosure. The figures in the instant disclosure are only for brief description, but they are not depicted according to actual size and do not reflect the actual size of the relevant structure. The following embodiments further illustrate related technologies of the instant disclosure in detail, but the scope of the instant disclosure is not limited herein.

First Embodiment

Firstly, please refer to FIGS. 1 to 4. A first embodiment of this instant disclosure provides an elastic abutting device P which is disposed on one link of a two link mechanism to solve a dead point problem generated by the two link mechanism. For instance, the elastic abutting device P includes a base member 1, a bearing member 2, a latch member 3, and an elastic member 4. The latch member 3 is abutted against by the elastic member 4 to reciprocate between a first position and a second position relative to the base member 1.

Specifically, in the first embodiment of this instant disclosure, the base member 1 has an accommodating groove G, the bearing member 2 is disposed in the accommodating groove G, but it is not limited herein. In other embodiments, the base member 1 and the bearing member 2 are formed into one piece. Then, the bearing member 2 has a first propping portion 21, a second propping portion 22 corresponding to the first propping portion 21, a connecting portion 23 connected between the first propping portion 21 and the second propping portion 22, and a through hole 222. The first propping portion 21 and the second propping portion 22 cooperatively define a receiving space S, and the elastic member 4 and a part of latch member 3 are disposed in the receiving space S. In addition, the through hole 222 is disposed on the second propping portion 22, and the receiving space S and the through hole 222 are communicated with each other.

Preferably, an external thread structure is formed on an outer surrounding surface of the connecting portion 23, an internal thread structure is formed on an inner surrounding surface of the accommodating groove G, and the bearing member 2 is movably disposed in the accommodating groove G through its external thread structure and the internal thread structure of the accommodating groove G. It is worth mentioning that the bearing member 2 further has an adjustment end 221 which is disposed on the first propping portion 21, but it is not limited herein. For instance, in other embodiments, the adjustment end 221 also can be disposed on the second propping portion 22. Described in detail, the adjustment end 221 disposed on the first propping portion 21 can be an inner hexagonal form. In other words, if the adjustment end 221 is disposed on the second propping portion 22, it can be an outer hexagonal form (not shown), but it is not limited herein According to the above, the latch member 3 defines a central axis C, and the latch member 3 is a columnar body. The latch member 3 has an abutting portion 31 which is partly exposed out of the through hole 222, a retaining portion 32 which is disposed correspondingly to the abutting portion 31, and a joining portion 33 which is connected between the abutting portion 31 and the retaining portion 32. The retaining portion 32 has a propping surface 321 and a stopping surface 322 corresponding to the propping surface 321, and the retaining portion 32 is disposed in the receiving space S. The retaining portion 32 is abutted against by the elastic member 4 to move into the receiving space S.

Next, the elastic member 4 is disposed between the first propping portion 21 and the second propping portion 22, two opposite terminal ends of the elastic member 4 respectively have a first side end portion 41 and a second side end portion 42 disposed correspondingly to the first side end portion 41. The retaining portion 32 of the latch member 3 is disposed between the second side end portion 42 of the elastic member 4 and the second propping portion 22, such that the first side end portion 41 of the elastic member 4 is propped against the first propping portion 21 of the bearing member 2, the second side end portion 42 of the elastic member 4 is propped against the propping surface 321 of the latch member 3, so that the stopping surface 322 of the latch member 3 is propped against the second propping portion 22, and the latch member 3 is abutted against by the elastic member 4 to reciprocate between a first position and a second position relative to the base member 1 along the central axis C. It is worth to note that the elastic member 4 can be a compression spring, but it is not limited herein.

Additionally, it is worth mentioning that via the external thread structure of the bearing member 2 and the internal thread structure of the accommodating groove G, an extended distance can be adjusted to control a pressure that the latch member 3 applies on an object.

Second Embodiment

Figure 5:
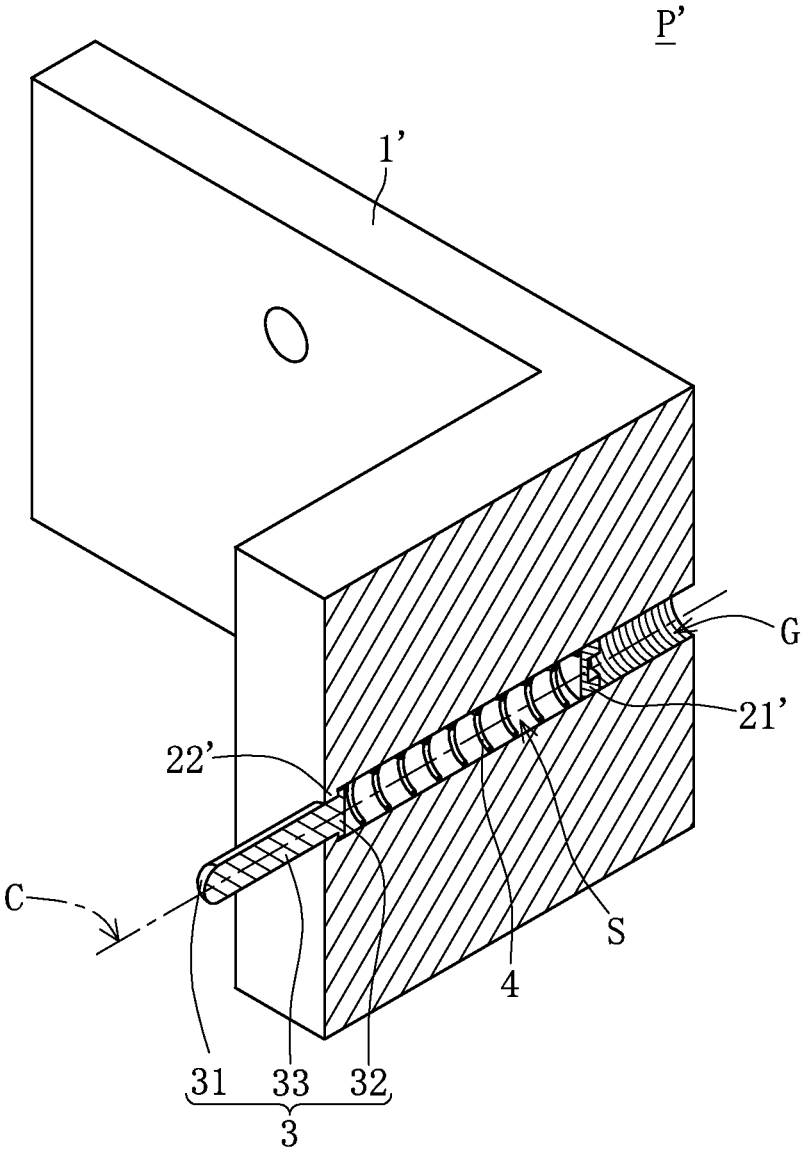
FIG. 5 shows a cross-sectional perspective view similar to that of FIG. 3 along line III-III of FIG. 1 of an elastic abutting device of a second embodiment in the instant disclosure.
Figure 6:
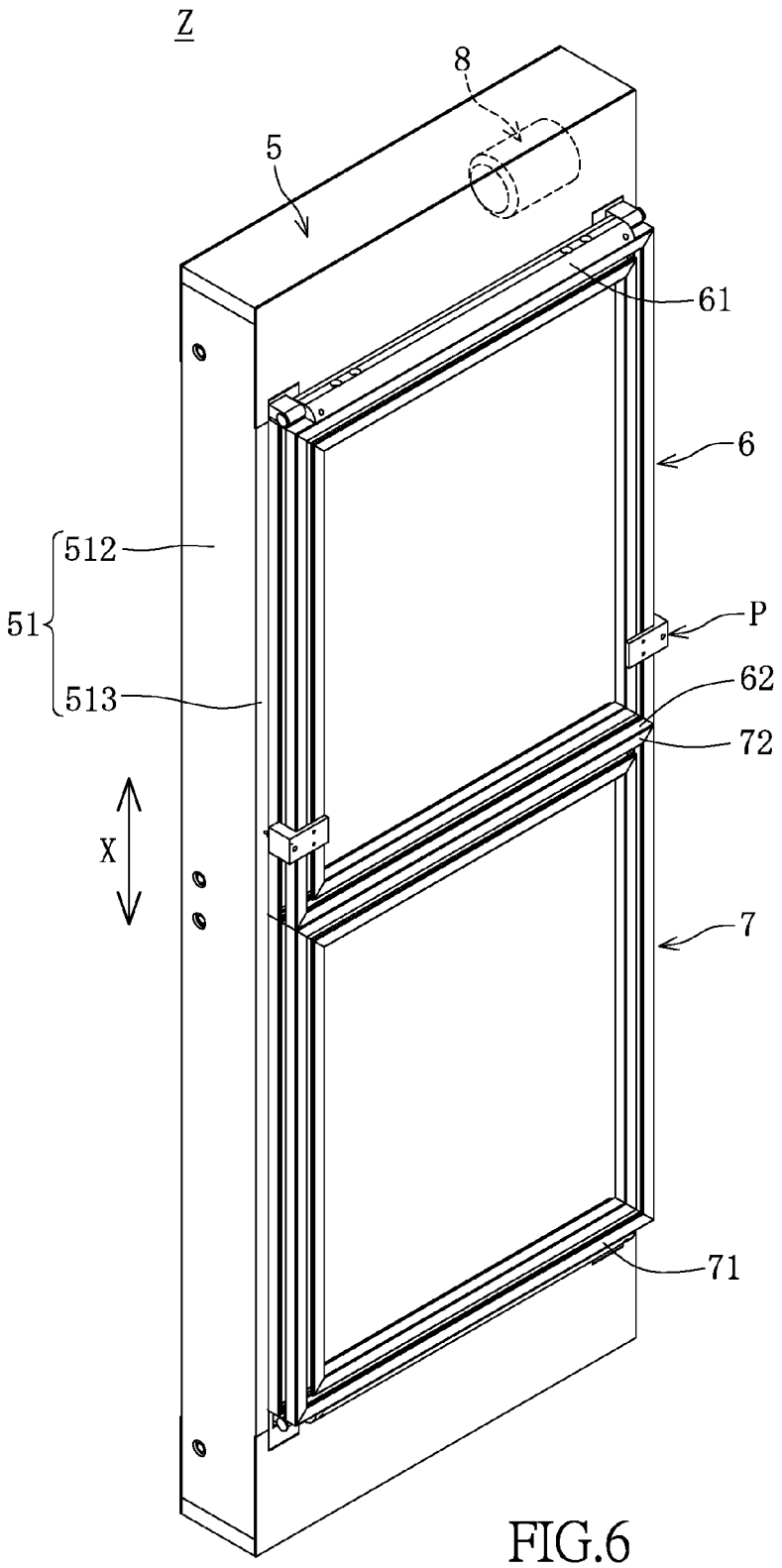
FIG. 6 shows one of the perspective views of a movement device of a third embodiment in the instant disclosure.
Figure 7:
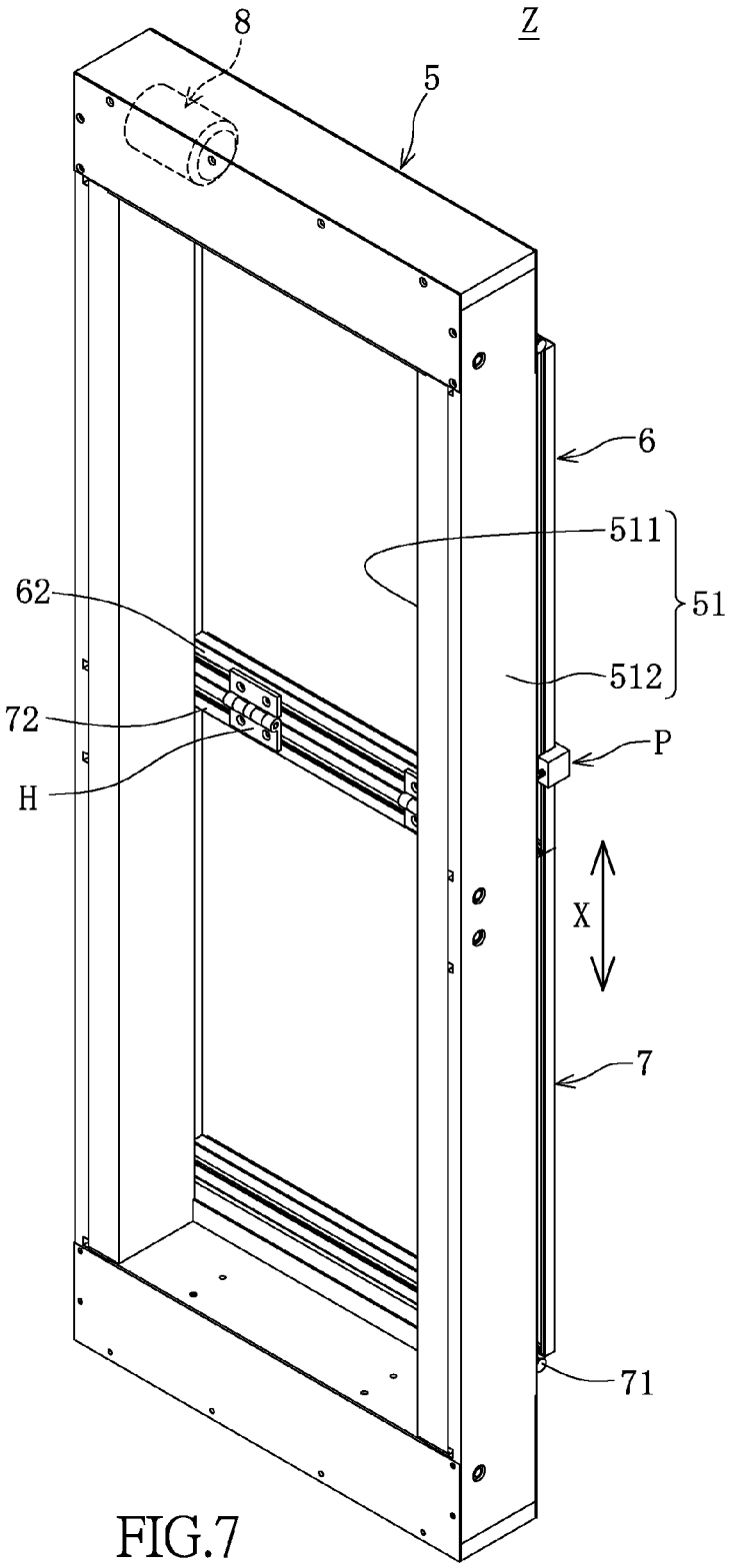
FIG. 7 shows another perspective view of a movement device of a third embodiment in the instant disclosure.
Figure 8:
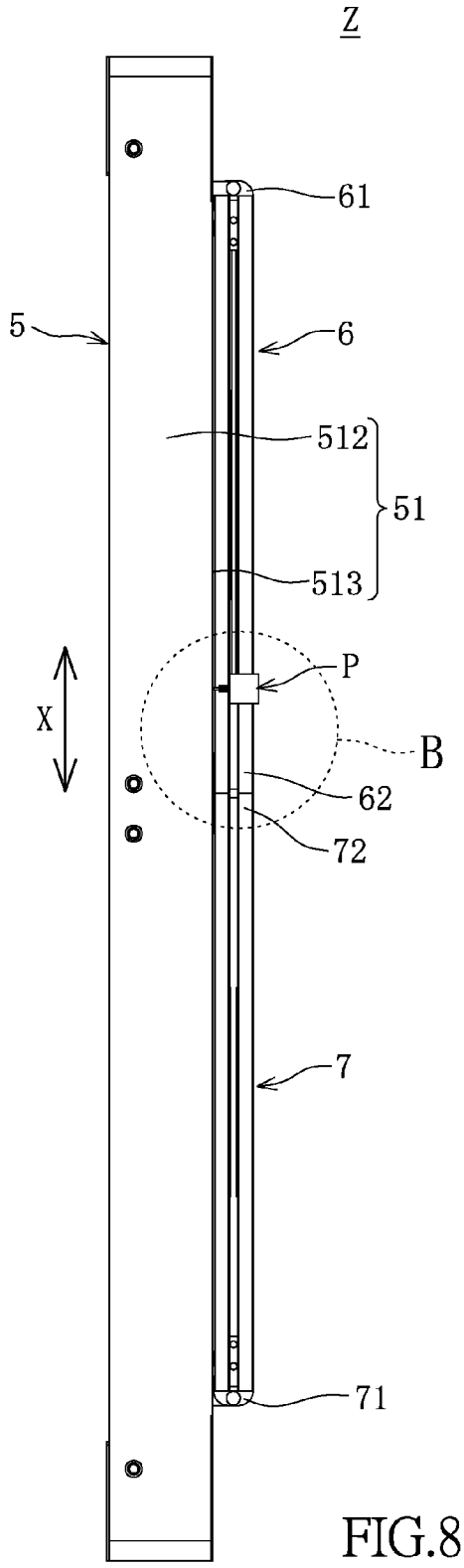
FIG. 8 shows a schematic side view of a movement device of a third embodiment in the instant disclosure.

Firstly, please refer to FIG. 5. A second embodiment of this instant disclosure provides an elastic abutting device P'. Comparing FIG. 5 and FIG. 3, the greatest difference between the second embodiment and the first embodiment is that, in the elastic abutting device P' of the second embodiment, the base member 1' and the second propping portion 22' of the bearing member 2 are formed into one piece, an external thread structure is formed on the first propping portion 21', an internal thread structure is formed on the accommodating groove G, and the first propping portion 21' is movably disposed in the accommodating groove G through the external thread structure itself and the internal thread structure of the accommodating groove G. Accordingly, the bearing member 2 can be without the connecting portion 23 connected between the first propping portion 21' and the second propping portion 22'.

In other words, in the elastic abutting device P' of the second embodiment, via the elastic member 4 disposed between the first propping portion 21' and the second propping portion 22', and at the same time, via the external thread structure of the first propping portion 21' and the internal thread structure of the accommodating groove G, a pressure of the spring can be adjusted to control the pressure applied on the object by the latch member 3. Other structures of the elastic abutting device P' of the second embodiment are similar to that of the elastic abutting device P of the first embodiment, so it does not bear repeating herein.

Third Embodiment

Firstly, please refer to FIGS. 6 to 8, and FIG. 11. A third embodiment of this instant disclosure provides a movement device having a two link mechanism Z which includes a frame unit 5, a first movement unit 6, a second movement unit 7, and an elastic abutting device P. The frame unit 5 defines a major axis direction X. The first movement unit 6 and the second movement unit 7 are moved along the major axis direction X. In addition, it is worth noting that, the elastic abutting device (P, P') of the third embodiment is similar to the previous embodiments, so it does not bear repeating herein. In other words, the elastic abutting device (P, P') of the first and second embodiments can be utilized in the third embodiment. In addition, in the third embodiment, the movement device having the two link mechanism Z can be a movable window, so as to form a window-shaped movement device Z.

The first movement unit 6 includes a first positioning portion 61 and a first pin joint portion 62 disposed correspondingly to the first positioning portion 61, and the first positioning portion 61 is pin-jointed with the frame unit 5. In other words, the first positioning portion 61 and the first pin joint portion 62 can be respectively disposed at two opposite ends of the first movement unit 6. Additionally, the second movement unit 7 includes a second pin joint portion 72 and a second positioning portion 71 disposed correspondingly to the second pin joint portion 72, and the second pin joint portion 72 of the second movement unit 7 and the first pin joint portion 62 of the first movement unit 6 are pin-jointed with each other, such that the first movement unit 6 and the second movement unit 7 are rotatably pivoted with each other. For instance, the first movement unit 6 and the second movement unit 7 can be rotatably pivoted using a hinge H therebetween, but it is not limited herein. The second positioning portion 71 of the second movement unit 7 is slidably disposed on the frame unit 5, so that the second movement unit 7 is moved toward or away from the first positioning portion 61 along the major axis direction X. For instance, a drive unit 8 (e.g., stepper motor) can be disposed on the frame unit 5, and the drive unit 8 can be used to drive the second movement unit 7 moving toward or away from the first positioning portion 61 along the major axis direction X. In addition, a track is disposed on the frame unit 5, such that the second positioning portion 71 of the second movement unit 7 is driven by the drive unit 8 to slide along a path of the track, and the path of the track can be identical with the major axis direction X. When the second movement unit 7 is moved toward or away from the first positioning portion 61 along the major axis direction X, the first positioning portion 61 of the first movement unit 6 can be rotatably pivoted on the frame unit 5. When the second movement unit 7 is moved away from the first positioning portion 61 along the major axis direction X, the second movement unit 7 is driven by the drive unit 8 to move to a position where is parallel to the first movement unit 6.

Figure 9:
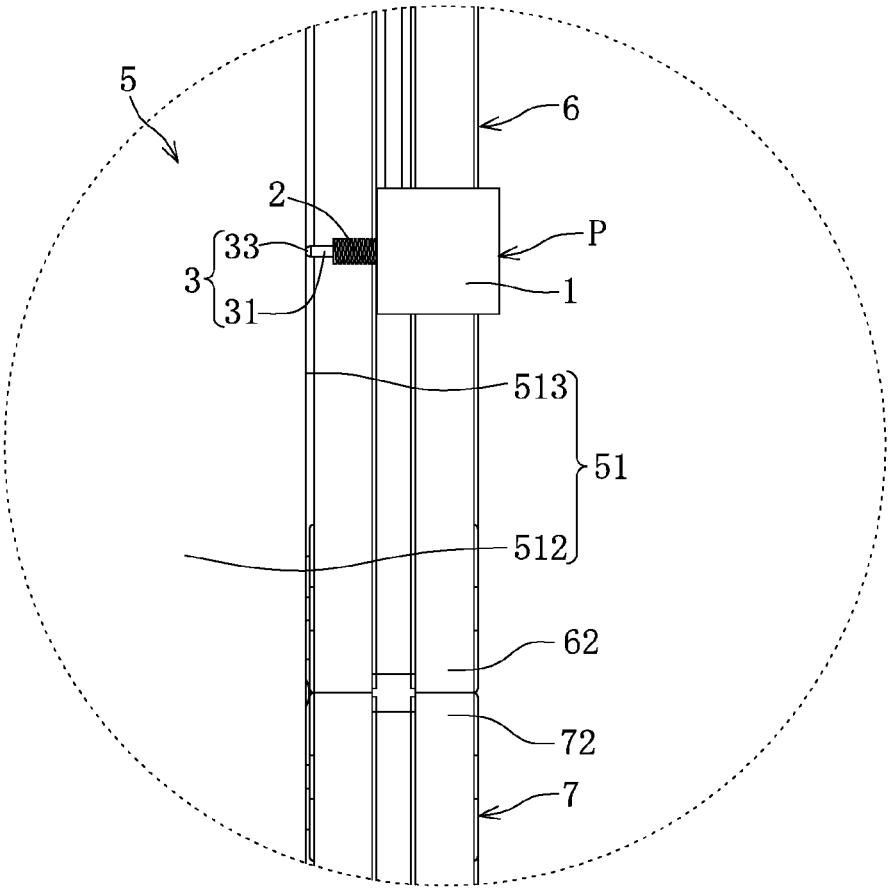
FIG. 9 shows a partial enlarged schematic view of one of the use states of B part of FIG. 8.
Figure 10:
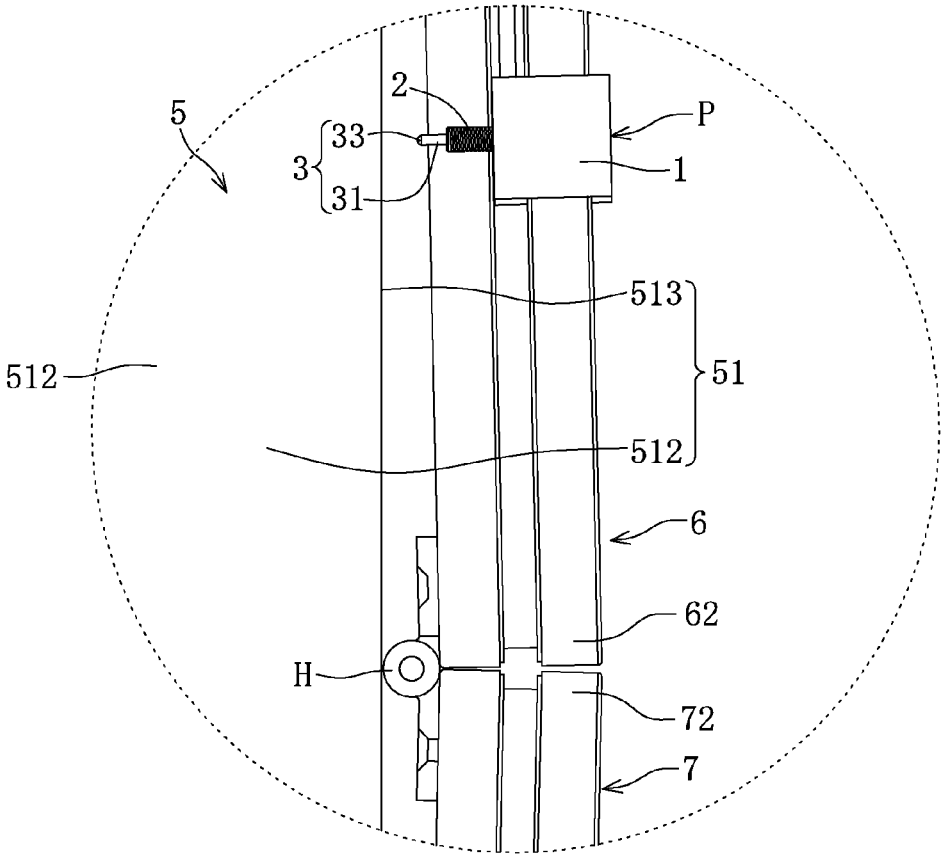
FIG. 10 shows a partial enlarged schematic view of another use state of B part of FIG. 8.
Figure 11:
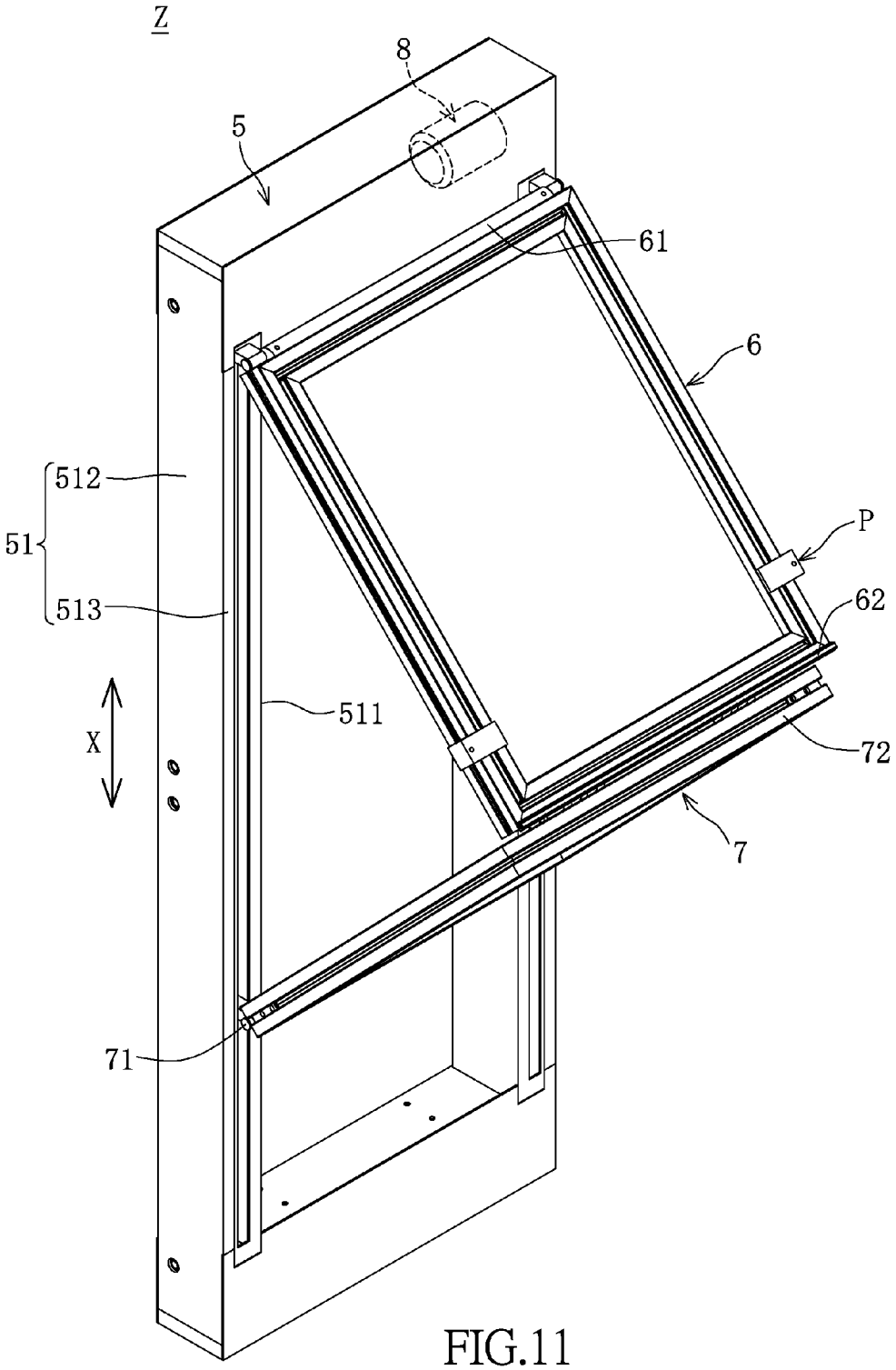
FIG. 11 shows a perspective view of a movement device of a third embodiment in the instant disclosure.

Next, please refer to FIGS. 9 and 10. For instance, the frame unit 5 includes two supporting stands 51 that are disposed correspondingly with each other. Each of the supporting stands 51 has an inner side surface 511, an outer side surface 512 opposite to the inner side surface 511, and two side surfaces 513 connecting between the inner side surface 511 and the outer side surface 512. The two inner side surfaces 511 of the supporting stand 51 are disposed facing to each other to form the frame unit 5. The first movement unit 6 and the second movement unit 7 are both disposed between the two supporting stands 51, the first positioning portion 61 of the first movement unit 6 and the second positioning portion 71 of the second movement unit 7 are both pin-jointed with the two supporting stands 51. Accordingly, when the elastic abutting device P is disposed on the first movement unit 6 or the second movement unit 7 through the base member 1, the latch member 3 is abutted against by the elastic member 4 and the frame unit 5 to reciprocate between a first position and a second position relative to the base member 1 along the central axis C. In other words, when the second movement unit 7 is moved away from the first positioning portion 61 along the major axis direction X, the second movement unit 7 is driven by the drive unit 8 to move to the position where it is parallel to the first movement unit 6. The window-shaped movement device Z is closed by fixing its position through the drive unit 8. Then, when a user would like to pull the second movement unit 7 by the drive unit 8 to open the window-shaped movement device Z, the abutting portion 31 of the latch member 3 of the elastic abutting device P is abutted against one of the side surfaces 513 of the supporting stand 51, such that the movement device of the two link mechanism Z is kept from a dead point status. The second movement unit 7 is pulled by the drive unit 8 (as shown in FIG. 11) to open the window-shaped movement device Z. Furthermore, it is worth mentioning that via the external thread structure and the internal thread structure of the elastic abutting device P, a force applied on the frame unit 5 can be adjusted to adapt different structures or weights to the movement device Z.

Efficacy of Embodiments

In summary, the instant disclosure having an advantage in that, the movement device Z and the elastic abutting device (P, P') of two link mechanism of the embodiment in this instant disclosure can avoid a dead point problem generated by the two link mechanism or the movement device Z with a two link mechanism, by a slight elasticity applied from the elastic member 4 of the elastic abutting device (P, P'). In addition, via the external thread structure and the internal thread structure of the elastic abutting device (P, P'), the force applied on the frame unit 5 can be adjusted.

The descriptions illustrated supra set forth simply the preferred embodiments of the present invention; however, the characteristics of the present invention are by no means restricted thereto. All changes, alterations, or modifications conveniently considered by those skilled in the art are deemed to be encompassed within the scope of the present invention delineated by the following claims.

What is claimed is:

1. An elastic abutting device which is disposed on one link of a two link mechanism, comprising:

a base member having an accommodating groove;

a bearing member disposed in the accommodating groove, wherein the bearing member has a first propping portion, a second propping portion corresponding to the first propping portion, and a through hole, the first propping portion and the second propping portion cooperatively define a receiving space, the through hole is disposed on the second propping portion, and the receiving space and the through hole are communicated with each other;

a latch member defining a central axis, the latch member having an abutting portion which is partly exposed out of the through hole and a retaining portion which is disposed correspondingly to the abutting portion, wherein the retaining portion has a propping surface and a stopping surface corresponding to the propping surface; and an elastic member disposed between the first propping portion and the second propping portion, wherein two opposite terminal ends of the elastic member respectively have a first side end portion and a second side end portion disposed correspondingly to the first side end portion;

wherein the retaining portion is disposed between the elastic member and the second propping portion, the first side end portion is propped against the first propping portion, and the second side end portion is propped against the propping surface of the latch member, so that the latch member is abutted against by the elastic member to reciprocate between a first position and a second position relative to the base member along the central axis.

2. The elastic abutting device as claimed in claim 1, wherein the bearing member further has a connecting portion which is connected between the first propping portion and the second propping portion, an external thread structure is formed on the connecting portion, an internal thread structure is formed on the accommodating groove, and the bearing member is movably disposed in the accommodating groove through the external thread structure and the internal thread structure.

3. The elastic abutting device as claimed in claim 1, wherein the elastic member is a compression spring.

4. The elastic abutting device as claimed in claim 1, wherein the bearing member has an adjustment end disposed on the first propping portion.

5. The elastic abutting device as claimed in claim 1, wherein the second propping portion of the base member and the bearing member are formed into one piece, an external thread structure is formed on the first propping portion, an internal thread structure is formed on the accommodating groove, and the first propping portion is movably disposed in the accommodating groove through the external thread structure and the internal thread structure.

6. A movement device having a two link mechanism, comprising:

a frame unit defining a major axis direction;

a first movement unit including a first positioning portion and a first pin joint portion disposed correspondingly to the first positioning portion, and the first positioning portion being pin-jointed with the frame unit;

a second movement unit including a second pin joint portion and a second positioning portion disposed correspondingly to the second pin joint portion, wherein the second positioning portion is slidably disposed on the frame unit, so that the second movement unit is moved toward or away from the first positioning portion along the major axis direction; and an elastic abutting device comprising:

a base member disposed on the first movement unit or on the second movement unit, wherein the base member has an accommodating groove;

a bearing member disposed in the accommodating groove, wherein the bearing member has a first propping portion, a second propping portion corresponding to the first propping portion, and a through hole, the first propping portion and the second propping portion cooperatively define a receiving space, the through hole is disposed on the second propping portion, the through hole is disposed on the second propping portion, and the receiving space and the through hole are communicated with each other;

a latch member defining a central axis, the latch member having an abutting portion which is partly exposed out of the through hole and a retaining portion which is disposed correspondingly to the abutting portion, wherein the retaining portion has a propping surface and a stopping surface corresponding to the propping surface; and an elastic member disposed between the first propping portion and the second propping portion, wherein two opposite terminal ends of the elastic member respectively have a first side end portion and a second side end portion disposed correspondingly to the first side end portion;

wherein the retaining portion is disposed between the elastic member and the second propping portion, the first side end portion is propped against the first propping portion, and the second side end portion is propped against the propping surface of the latch member, so that the latch member is abutted against by the elastic member and the frame unit to reciprocate between a first position and a second position relative to the base member along the central axis.

7. The movement device having the two link mechanism as claimed in claim 6, further comprising a drive unit disposed on the frame unit, and the drive unit driving the second movement unit to move toward or away from the first positioning portion along the major axis direction, when the second movement unit being moved away from the first positioning portion along the major axis direction, the second movement unit being driven by the drive unit to a position where is parallel to the first movement unit.

8. The movement device having the two link mechanism as claimed in claim 7, wherein the frame unit includes two supporting stands that are disposed correspondingly with each other, each of the supporting stands has an inner side surface, an outer side surface opposite to the inner side surface, and two side surfaces connecting between the inner side surface and the outer side surface, the two inner side surfaces of the supporting stand are disposed facing to each other, the first movement unit and the second movement unit are both disposed between the two supporting stands, the first positioning portion and the second positioning portion are both pin-jointed with the two supporting stands, and the abutting portion is abutted against the side surface.

9. The movement device having the two link mechanism as claimed in claim 7, wherein the bearing member further has a connecting portion which is connected between the first propping portion and the second propping portion, an external thread structure is formed on the connecting portion, an internal thread structure is formed on the accommodating groove, and the bearing member is movably disposed in the accommodating groove through the external thread structure and the internal thread structure.

10. The movement device having the two link mechanism as claimed in claim 7, wherein the second propping portion of the base member and the bearing member is formed into one piece, an external thread structure is formed on the first propping portion, an internal thread structure is formed on the accommodating groove, and the first propping portion is movably disposed in the accommodating groove through the external thread structure and the internal thread structure.

* * * * *